United States Patent [19]

Pfeiffer

[11] Patent Number: 4,488,134

[45] Date of Patent: Dec. 11, 1984

[54] TRANSFORMER WITH WINDINGS COMPLETELY EMBEDDED IN CAST RESIN

[75] Inventor: Richard Pfeiffer, Stein, Fed. Rep. of Germany

[73] Assignee: Transformatoren Union Aktiengesellschaft, Stuttgart, Fed. Rep. of Germany

[21] Appl. No.: 422,183

[22] Filed: Sep. 23, 1982

[30] Foreign Application Priority Data

Sep. 30, 1981 [DE] Fed. Rep. of Germany ..... 3138909

[51] Int. Cl.[3] ..... H01F 27/10

[52] U.S. Cl. ..... 336/58; 336/60; 336/94; 336/96; 336/196; 336/205; 336/55

[58] Field of Search ..... 336/58, 60, 94, 96, 336/196, 205

[56] References Cited

U.S. PATENT DOCUMENTS 3,028,566 4/1962 Camilli ..... 336/60 X

FOREIGN PATENT DOCUMENTS 525065 5/1956 Canada ..... 336/60
762171 5/1954 Fed. Rep. of Germany ..... 336/60
462919 4/1951 Italy ..... 174/15 R

*Primary Examiner*—A. D. Pellinen
*Assistant Examiner*—Susan Steward
*Attorney, Agent, or Firm*—Herbert L. Lerner; Laurence A. Greenberg

[57] ABSTRACT

Transformer, including an iron core, high voltage and low voltage windings, at least one cast resin body completely embedding, holding and insulating the windings, the cast resin body having cooling channels formed therein and having additional channels formed therein being separated from the cooling channels, and insulating gas filling the additional channels.

9 Claims, 1 Drawing Figure

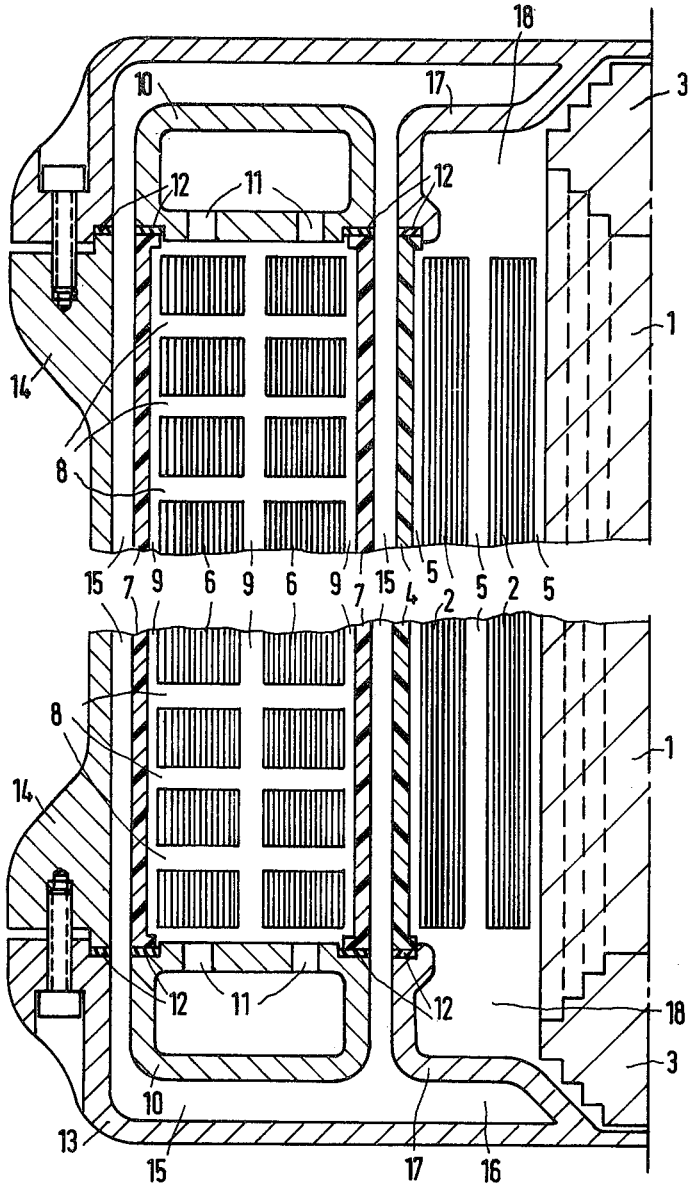
18
10
17
3
12
11
12
1
14
8
15
7
9
6
9
6
9
7
15
4
2
5
2
5
8
1
14
12
11
12
18
3
10
13
15
17
16

TRANSFORMER WITH WINDINGS COMPLETELY EMBEDDED IN CAST RESIN

BACKGROUND OF THE INVENTION

Field of the Invention

The invention relates to transformers with an iron core, high voltage and low voltage windings which are completely embedded in cast resin, and cooling channels formed inside the cast resin body which holds and insulates the windings.

Description of the Prior Art

In such an apparatus, known from German Patent De-PS No. 20 32 507, electrically conducting water serves as the cooling medium. Through this electrically conducting water also advantageously serves as electrical shielding, it limits the application of the known apparatus to transformers with relatively low nominal voltages, because its use in transformers for higher voltages requires uneconomically large wall thicknesses of the cast resin body. Beyond this, large wall thicknesses easily lead to cracks in the cast resin body, and furthermore act as thermal insulators in an undesirable way.

A cast resin transformer is known from German Published, Non-Prosecuted Application DE-OS No. 28 26 299, corresponding to U.S. Pat. No. 4,236,134, wherein all windings of a poly-phase current system are enclosed in a cast resin block, which on one hand has perforations for holding the legs of an iron core, and on the other hand has recesses in front of the end faces of the windings for holding an upper and a lower yoke. In such an apparatus, the recesses which hold the yokes are watertightly closed to the outside by caps. Because there is no cooling provided inside the coil and inside the core, transformers of this type of construction are limited to relatively small nominal power applications.

SUMMARY OF THE INVENTION

It is accordingly an object of the invention to provide a transformer with windings being completely embedded in cast resin, which overcomes the hereinaforementioned disadvantages of the heretofore-known devices of this general type, which permits a compact construction even for greater nominal power, due to an effective cooling system, and beyond this is also applicable for high nominal voltages.

With the foregoing and other objects in view there is provided, in accordance with the invention, a transformer, including an iron core, high voltage and low voltage windings, at least one cast resin body completely embedding, holding and insulating the windings, the cast resin body having cooling channels formed therein and having additional channels formed therein, at least in the main stray or dispersion channel, being separated from the cooling channels, and insulating gas filling the additional channels.

In accordance with another feature of the invention, the core has a leg, the low voltage winding has an outer mantle and end faces, the high voltage winding has connecting conductors, the high voltage winding has at least a portion of the cooling channels formed in the interior thereof and is surrounded on all sides by at least a portion of the additional gas-filled channels, the low voltage winding is disposed radially between the high voltage winding and the core leg and is surrounded by the additional gas-filled insulating channels at the mantle and side or end faces thereof, the cast resin body having the cooling channels formed therein is a common body for the iron core and the low voltage winding, and the connecting conductors of the high voltage winding are mainly or essentially insulated by the insulating gas.

In accordance with a further feature of the invention, the high voltage winding is formed of coils being axially disposed on top of each other and being electrically connected together in series, the coils being formed of a metal band having the width of the coils, and the low voltage winding is formed of a spirally wound metal band having a width being equal to the axial length of the coils.

In accordance with an additional feature of the invention, there is provided an electrically insulating liquid disposed in the cooling channels as a cooling medium.

In accordance with an added feature of the invention, the cooling medium is evaporatable in the cooling channels.

In accordance with yet another feature of the invention, the insulating gas in the additional channels is $SF_6$ and is under a positive pressure.

In accordance with yet a further feature of the invention, the cooling channels and additional channels are each connected to form independent channel systems, each of the channel systems being connected to at least one of a heat exchanger or reserve tank for each channel system for setting the interior pressure therein.

In accordance with yet an additional feature of the invention, the interior pressure in the cooling channels is held between the ambient pressure outside the transformer and the pressure in the additional channels, independent of the operating state of the transformer.

In accordance with yet an added feature of the invention, there is provided glass fibers reinforcing the walls of the additional gas-filled channels. This is done is order to reliably withstand even higher pressures in the additional channels.

In accordance with a concomitant feature of the invention at least one cast resin body containing the high voltage and low voltage windings is elastically fixed relative to the iron core and serves as an insulating well for noises radiating from the iron core. The purpose of this feature is to reduce the noise emanating from transformers constructed according to the invention.

The construction of transformers according to the invention has great advantages, because it expands the application range of cast resin insulated transformers so that they can be used for higher nominal power applications, due to the reduced amount of casting resin required and their absolute winding dimensions. This furthermore permits their use at higher nominal voltages than that to which they were previously suited.

Other features which are considered as characteristic for the invention are set forth in the appended claims.

Although the invention is illustrated and described herein as embodied in a transformer with windings completely embedded in cast resin, it is nevertheless not intended to be limited to the details shown, since various modifications and structural changes may be made therein without departing from the spirit of the invention and within the scope and range of equivalents of the claims.

BRIEF DESCRIPTION OF THE DRAWING

The construction and method of operation of the invention, however, together with additional objects and advantages thereof will be best understood from the following description of specific embodiments when read in connection with the single FIGURE of the drawing which is a fragmentary, diagrammatic cross-sectional view of a transformer according to the invention.

DESCRIPTION OF THE PREFERRED EMBODIMENT

Referring now to the single FIGURE of the drawing in detail, it is seen that the leg 1 of a transformer core is enclosed by a low voltage winding 2. The core leg 1 is formed of layers of steel laminations in the conventional manner and is connected through yokes or crossbars 3 with additional core legs of a poly-phase current transformer, in a way which is not further illustrated.

The actual low voltage winding 2 itself is formed of a metal band, which has a width that is equal to the length of the winding, and which is embedded in a body 4 of cast resin after the winding operation. Cooling channels 5 are thus provided around the low voltage winding 2.

A high voltage winding, which in turn encloses or surrounds the low voltage winding 2, is constructed of a great number of coils 6 that are axially disposed on top of each other. The individual coils 6 are wound from a metal (steel) band having the width of the coil, and are electrically connected in series. The coils 6 are mechanically connected by a body 7 made of cast resin. The body 7 and the coils 6 together form a grid of radial cooling channels 8 and axial cooling channels 9.

The annular end faces of the body 7 which encloses the coils 6 are gas-tightly closed by closure rings 10, with ring gaskets 12 clamped between the body 7 and the closure rings 10. The hollow space formed in the closure rings 10 is connected with the grid formed by the cooling channels 8 and 9 by channels 11. The closure rings 10 simultaneously serve as a collector chamber for conducting the cooling medium to and from the high voltage winding.

The iron core formed of the core legs 1 and the yokes 3, the low voltage winding 2 in the body 4, and the high voltage winding constructed of the coils 6 in the body 7, are encapsulated and separated from the outside by a mantle or shell 14 and by a cover 13. Therefore, the mantle 14 with the outer surface of the body 7, and the cover 13 with the closure rings 10, form channels 15, which are kept open by non-illustrated spacers, preferably formed in the cast resin body.

Disposed inside the cover 13 are support walls 17 for clamping the low voltage winding. A suitable construction of the support walls 17 forms extension channels 16 between a support wall and the respective cover 13. The extension channels 16 are directly connected with the channels 15. The walls of the additional channels 15, 16 are reinforced with glass fibers to withstand even higher pressures. The supporting walls 17 form chambers 18 in front of the low voltage winding 2. The chambers 18 are connected with the cooling channels 5 in the low voltage winding, and are open in direction toward the core legs 1 and the yokes 3. The chambers serve as a cooling medium storage collector for supplying and receiving the coolant for the low voltage winding and for the iron cores.

The contact surfaces between the covers 13 and the mantle 14 as well as between the supporting walls 17 and the body 4 which carries the low voltage winding 2, do not directly contact each other, but instead apply pressure to gasket rings 12 which gas-tightly close the gap between these parts. This makes it possible to fill the channels 15 and the channel extensions 16 with an insulating gas under positive pressure, such as $SF_6$, so that even high nominal voltages at the high voltage winding are reliably kept under control.

The iron core of the core legs 1 and the yokes 3 is elastically clamped between the covers 13, and from a vibration technology point of view, is decoupled from the windings.

The chambers in the closure rings 10 and the chambers 18 are connected in a non-illustrated manner with an expansion tank and a recooling device for the coolant which flows through the cooling channels 5, 8 and 9.

In practice, a non-flammable liquid serves as the coolant. The boiling temperature of the coolant lies at the operating pressure existing in the channels near the operating temperature of the low voltage winding 2 and the high voltage winding.

By providing a suitable construction and dimensioning of the cast resin body 4 and the body 7, it is possible to fabricate the mantle 14 and the covers 13 at least partially out of an electrically conducting metallic material.

I claim:

1. Transformer, comprising an iron core, high voltage and low voltage windings, at least one cast resin body completely embedding, holding and insulating said windings, said cast resin body having cooling channels formed therein and having additional channels formed therein being separated from said cooling channels, and insulating gas filling said additional channels, said core having a leg, said low voltage winding having an outer mantle and end faces, said high voltage winding having connecting conductors, said high voltage winding having at least a portion of said cooling channels formed in the interior thereof and being surrounded by at least a portion of said additional gas-filled channels, said low voltage winding being disposed radially between said high voltage winding and said core leg and being surrounded by said additional gas-filled channels at said mantle and end faces thereof, said cast resin body having said cooling channels formed therein being a common body for said iron core and said low voltage winding, and said connecting conductors of said high voltage winding being mainly insulated by said insulating gas.

2. Transformer according to claim 1, wherein said high voltage winding is formed of coils being axially disposed on top of each other and being electrically connected together in series, said coils being formed of a metal band having the width of said coils, and said low voltage winding is formed of a spirally wound metal band having a width being equal to the axial length of said coils.

3. Transformer, comprising an iron core, high voltage and low voltage windings, at least one cast resin body completely embedding, holding and insulating said windings, said cast resin body having cooling channels formed therein and having additional channels formed therein being separated from said cooling channels, insulating gas filling said additional channels, and an electrically insulating liquid disposed in said cooling channels as a cooling medium.

4. Transformer according to claim 3, wherein said cooling medium is evaporatable in said cooling channels.

5. Transformer according to claim 3, wherein said insulating gas in said additional channels is $SF_6$ and is under a positive pressure.

6. Transformer according to claim 3, wherein said cooling channels and additional channels are each connected to form independent channel systems, each of said channel systems being connected to at least one of a heat exchanger or reserve tank for each channel system for setting the interior pressure therein.

7. Transformer according to claim 6, wherein the interior pressure in said cooling channels is held between the ambient pressure outside the transformer and the pressure in said additional channels, independent of the operating state of the transformer.

8. Transformer according to claim 3, including glass fibers reinforcing the walls of said additional gas-filled channels.

9. Transformer according to claim 3, wherein said at least one cast resin body containing said high voltage and low voltage windings is elastically fixed relative to said iron core and serves as an insulating wall for noises radiating from said iron core.

* * * * *